US009476666B1

(12) United States Patent
Larner

(10) Patent No.: US 9,476,666 B1
(45) Date of Patent: Oct. 25, 2016

(54) QUICK-LOADING BOW AND ARROW TOY

(71) Applicant: Cole Ernest Larner, Portland, OR (US)

(72) Inventor: Cole Ernest Larner, Portland, OR (US)

( * ) Notice: Subject to any disclaimer, the term of this patent is extended or adjusted under 35 U.S.C. 154(b) by 0 days.

(21) Appl. No.: 14/621,336

(22) Filed: Feb. 12, 2015

Related U.S. Application Data

(60) Provisional application No. 61/940,326, filed on Feb. 14, 2014.

(51) Int. Cl.

| | |
|---|---|
| ***F41B 7/00*** | (2006.01) |
| ***F41B 5/00*** | (2006.01) |
| ***F41B 5/14*** | (2006.01) |
| ***F42B 6/02*** | (2006.01) |
| ***F41B 7/04*** | (2006.01) |

(52) U.S. Cl.
CPC ..... *F41B 5/1403* (2013.01); *F41B 5/00* (2013.01); *F41B 7/04* (2013.01); *F42B 6/02* (2013.01)

(58) Field of Classification Search
CPC ..... F41B 5/00; F41B 5/14; F41B 7/00; F41B 7/04
See application file for complete search history.

(56) References Cited

U.S. PATENT DOCUMENTS 3,834,368 A * 9/1974 Geiger ..... F41B 3/00 124/20.3
8,662,060 B2 * 3/2014 Walterscheid ..... F41B 5/12 124/20.3
8,689,773 B2 * 4/2014 Walterscheid ..... F41B 5/0094 124/23.1
8,991,373 B2 * 3/2015 Cummings ..... F41B 7/08 124/20.3

* cited by examiner

*Primary Examiner* — John Ricci
(74) *Attorney, Agent, or Firm* — Integral Patent; Laurence J. Shaw

(57) ABSTRACT

A bow and arrow toy having a light-weight, foam tipped arrow and a bow with rear and fore tension bands. To load and arm the toy, the rear of the arrow is abutted against the rear tension band and the shaft of the arrow is pressed against the fore tension band and drawn back. As the arrow is drawn back, the shaft of the arrow slides against the fore tension band until the fore tension band falls into an engagement slot along the shaft, causing the fore tension band to also become engaged and tensioned as the arrow is drawn back further. At the fore outside edge of the engagement slot is a catch lip which protrudes outwards from the shaft and functions to guide the fore tension band into the engagement slot if the pressure of the shaft against the fore tension band is not sufficient to cause the fore tension band to slide directly into the engagement slot. The fore tension band is comprised of three interlinked loops, with the central loop being sleeved so as to narrow its effective diameter. The front profile of the fore tension band, from top to bottom, slants rearward, is vertical and slants forward, thereby providing physical guidance for proper horizontal orientation of the arrow. The sleeved central loop differs in color from the top and bottom loops of the fore tension band to facilitate proper horizontal orientation of the arrow.

9 Claims, 6 Drawing Sheets

QUICK-LOADING BOW AND ARROW TOY

RELATED APPLICATIONS

The present non-provisional patent application is based on and claims priority of provisional patent application Ser. No. 61/940,326 filed Feb. 14, 2014 by Cole Ernest Larner for "Toy Projectile Launcher."

FIELD OF THE INVENTION

The present invention is related to toys, particularly flying and projectile launching toys, and more particularly toys where a projectile is launched by one or more tensioned bands, strings, straps, chords, etc.

BACKGROUND OF THE INVENTION

FIG. 1 depicts a bow and arrow toy (10) according to the prior art. The toy (10) has a bow (20) which consists of upper and lower body sections (24*a*) and (24*b*), respectively, which are connected to a middle body section (23) via upper and lower fore tension-string mounts (26*a*) and (26*b*), respectively. Central in the middle body section (23) is a handle (22). An elastomeric rear tension string (16) is secured at the top of the upper body section (24*a*) and at the bottom of the lower body section (24*b*). Parallel, elastomeric fore tension strings (12*a*) and (12*b*) are secured at the outside edges of the upper and lower fore tension-string mounts (26*a*) and (26*b*). The rear tension string (16) and the fore tension strings (12*a*) and (12*b*) may be made of any suitable elastomeric material such as latex.

The toy (10) shoots an arrow (30) which has a roughly cylindrical elongated shaft (32), a foam tip (34) at the front end of the shaft (32), and three fins (36) projecting laterally outwards at the rear end of the shaft (32). The longitudinal axes of the fins (36) are offset, each at the same angle, relative to the longitudinal axis of the shaft (32). Near the fore end of the shaft (32) of the arrow (30) are diametrically opposing engagement wings (18) (only one engagement wing is visible in FIG. 1) which protrude outwards from the shaft (32) and are angled towards the rear end of the shaft (32) so as to provide a crook between each wing (18) and the shaft (32) into which the fore tension strings (12*a*) and (12*b*) can be nested, as is depicted in FIG. 1. The fore tension strings (12*a*) and (12*b*) are separated by a distance slightly greater than the width of the shaft (32) of the arrow (30).

FIG. 1 depicts a loaded configuration of the bow toy (10) where the rear end of the shaft (32) abuts the rear tension string (16), and fore tension strings (12*a*) and (12*b*) are nested in the crooks of the engagement wings (18), i.e., at the inside junctions of the shaft (32) and engagement wings (18). As depicted in FIG. 2, the bow toy (10) is armed by gripping the handle (22) with the right hand (51), gripping the rear end of the arrow's shaft (32) with the left hand (52) with the rear end of the shaft (32) abutting the rear tension string (16), and pulling back the left hand (52) relative to the right hand (51). This increases the length of the rear tension string (16), resulting in increased tension in the rear tension string (16) and a force applied at the rear end of the shaft (32) directed forward along the longitudinal axis of the shaft (32). Drawing the arrow (30) also increases the length of the fore tension strings (12*a*) and (12*b*), resulting in increased tensions in the fore tension strings (12*a*) and (12*b*) and forward-directed forces applied to the shaft (32) of the arrow (30) via the wings (18).

Upon release of the rear end of the shaft (32), the forward directed forces applied by the rear tension string (16) and the fore tension strings (12*a*) and (12*b*) (collectively or generically to be referred to with reference numeral 12) propel the arrow (30) forward, and the arrow (30) is launched from the bow (20) into its trajectory.

It should be noted that a disadvantage of the design of the prior art bow and arrow toy (10) of FIG. 1, is that the loading of the arrow (30) must be accomplished by threading the arrow (30) through the space between the two fore tension strings (12*a*) and (12*b*), which is a space only slightly greater than the width of the shaft (32). The difficulty of the threading is compounded by the fact that only one hand (52) is available to hold and orient the arrow (30) since the other hand (51) is holding the bow (20), and the hand (52) holding the arrow (30) is typically holding the arrow (30) at its rear end. Therefore, the shooter (50) must counteract a not-insignificant downwards torque produced by the weight of the shaft (32) and foam tip (32) (and to some extent also the weight of the engagement wings (38)). So loading of the arrow (30) requires time and concentration, and the attention required to load the arrow (30) may be problematic in play battles with the toy (10) where an operator of the toy (10) may wish to fire arrows (30) in rapid succession.

It is therefore an object of the present invention to provide a bow and arrow toy with improved ease of loading.

It is another object of the present invention to provide a bow and arrow toy with fore and rear tension strings, and particularly doubled fore tension strings, where loading of the arrow does not require a precise orientation of the arrow or a threading maneuver with the arrow.

It is another object of the present invention to provide a bow and arrow toy with fore and rear tension strings, where placing and/or the orienting arrow is facilitated by the design of the bow.

It is another object of the present invention to provide a bow and arrow toy with fore and rear tension strings where loading of the arrow may be accomplished by a rotation of and/or sweeping motion with the arrow.

It is another object of the present invention to provide a bow and arrow toy with fore and rear tension strings where loading and drawing of the arrow may be accomplished in a single easy and natural motion.

It is another object of the present invention to provide a bow and arrow toy with fore and rear tension strings where wear and tear on the arrow due to launch forces and/or friction with the bow upon launch are reduced.

Additional objects and advantages of the invention will be set forth in the description which follows, and will be obvious from the description or may be learned by practice of the invention. The objects and advantages of the invention may be realized and obtained by means of the instrumentalities and combinations particularly pointed out in the claims.

BRIEF DESCRIPTION OF THE DRAWINGS

The accompanying figures, which are incorporated in and form a part of this specification, illustrate embodiments of the invention and, together with the description given above and the detailed description of the preferred embodiments given below, serve to explain the principles of the invention.

SUMMARY OF THE INVENTION

A bow and arrow toy having a bow with an elastomeric fore tension band, an elastomeric rear tension band, and an arced body where the arc of said body is concave to the rear. The rear tension band is secured to the body at an upper rear point and a lower rear point on the body, and the fore tension band is secured to the body at a forward upper point and a forward lower point. When unbiased, the fore and rear tension bands are separated by a band separation distance. The arrow has an elongate shaft with multiple fins protruding from the rear of the shaft, a soft tip at the fore of the shaft, and a forward slanting engagement slot have a width greater than a width of the fore tension band so said fore tension band may be lodged in the engagement slot, the engagement slot being a distance greater than band separation distance from the rear of the arrow. The arrow is launchable from the bow by (i) abutting a rear end of the shaft against the rear tension band, (ii) pressing a side of the shaft with the engagement slot against the fore tension band, (iii) drawing the arrow and rear tension band back, (iv) allowing the fore tension band to enter the engagement slot and abut the terminus, (v) continuing to draw the arrow back thereby increasing tension of the fore and rear tension bands and increasing forward forces applied by the fore and rear tension bands to the arrow, and (vi) releasing the arrow to allow the forward forces applied by the fore and rear tension bands to launch the arrow from the bow.

DETAILED DESCRIPTION OF THE PREFERRED EMBODIMENTS

Figure 3:
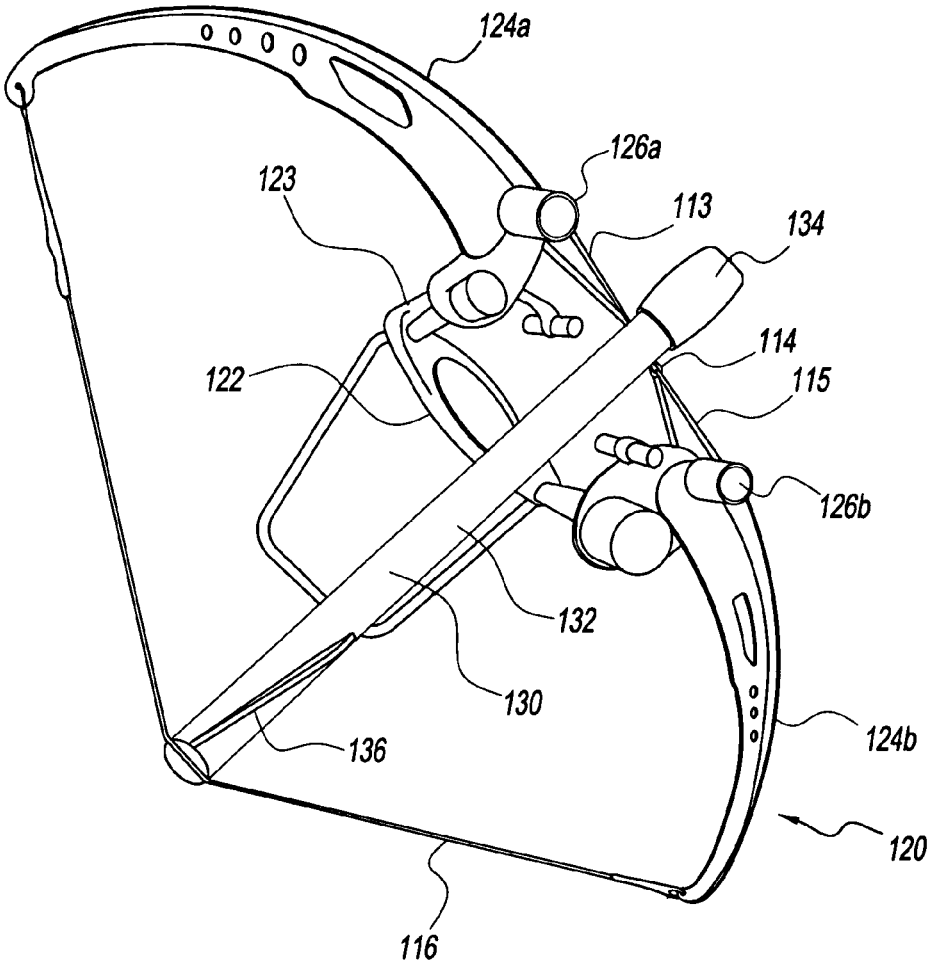
FIG. 3 shows a perspective view of a preferred embodiment of the bow and arrow toy according to the present invention.

FIG. 3 depicts a bow and arrow toy (110) according to a preferred embodiment of the present invention. The toy (110) has a bow (120) which has upper and lower body sections (124*a*) and (124*b*), respectively, which are connected to a middle body section (123) via upper and lower fore tension-string mounts (126*a*) and (126*b*), respectively. Central in the middle body section (123) is a handle (122). A rear tension string (116) is secured at the top of the upper body section and at the bottom of the lower body section (124*b*).

Figure 1:
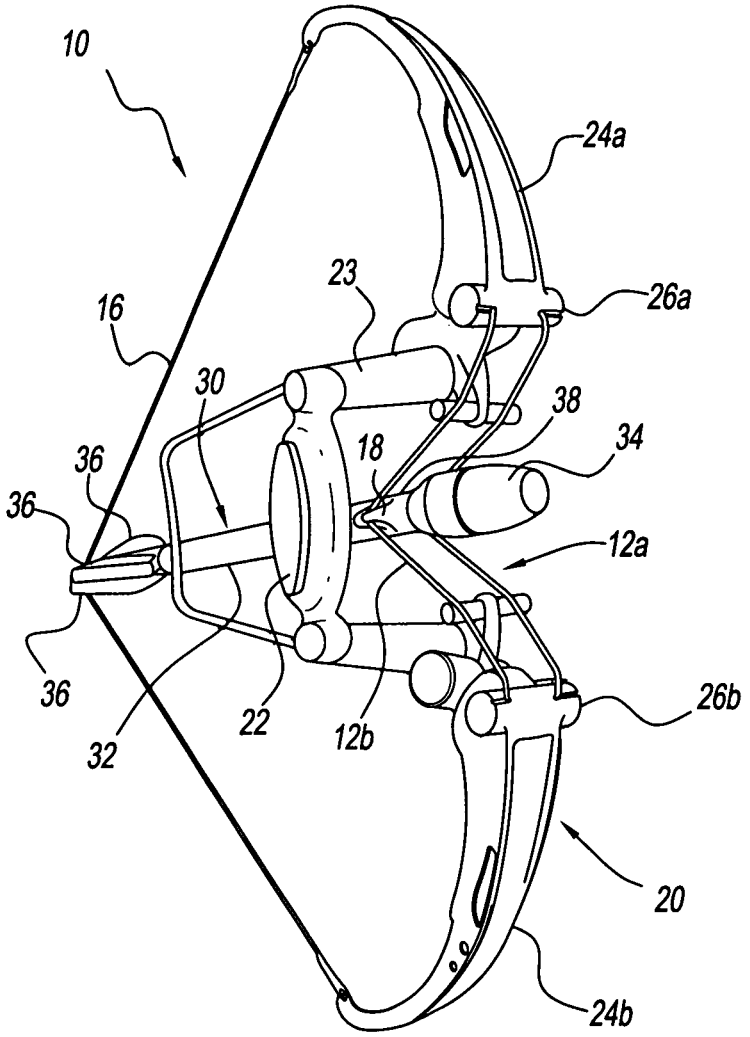
FIG. 1 PRIOR ART
FIG. 1 shows a perspective view of a bow and arrow toy according to the prior art.
Figure 2:
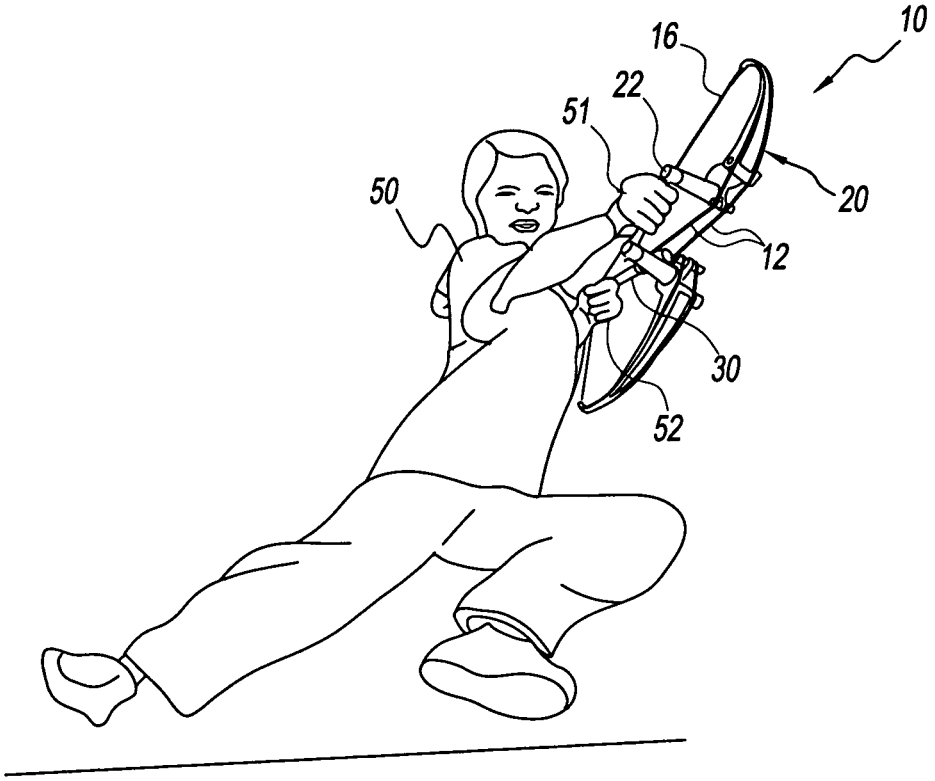
FIG. 2 PRIOR ART
FIG. 2 shows the bow and arrow toy of FIG. 1 in use.
Figure 4:
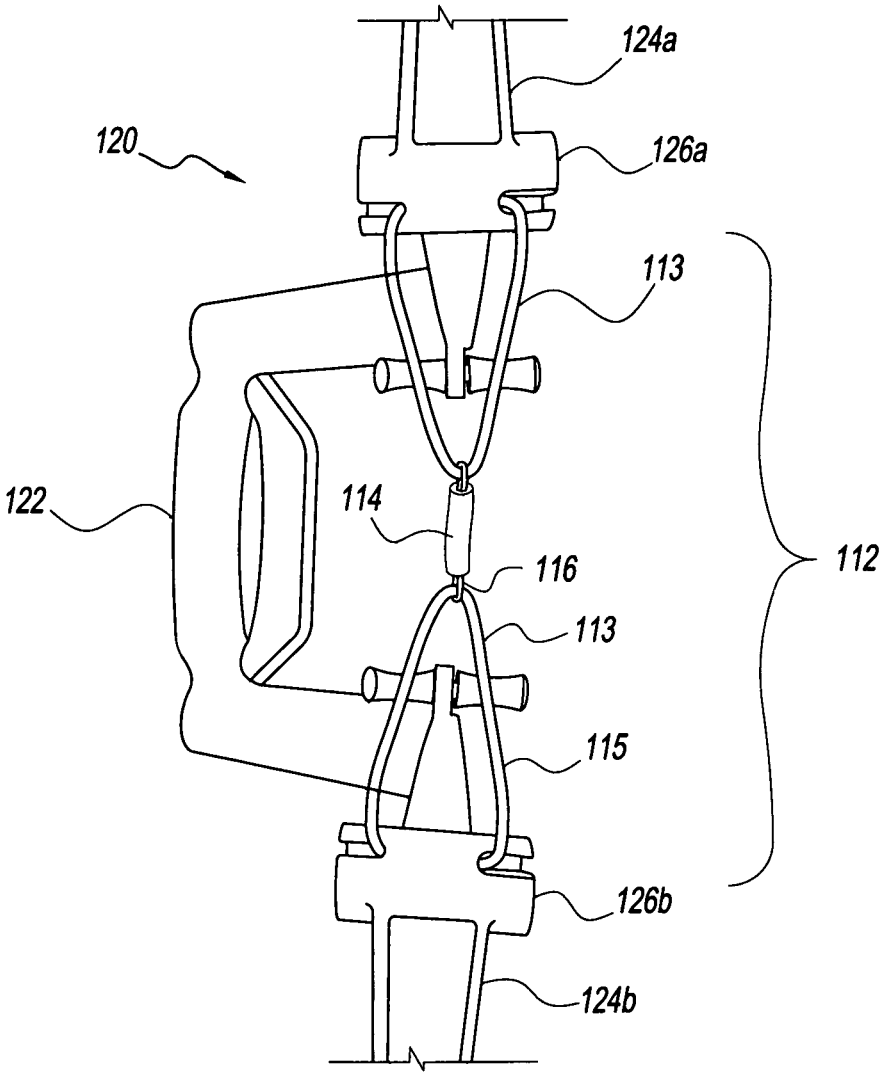
FIG. 4 is a close-up side view of the fore tension band of the bow and arrow toy of FIG. 3.
Figure 5:
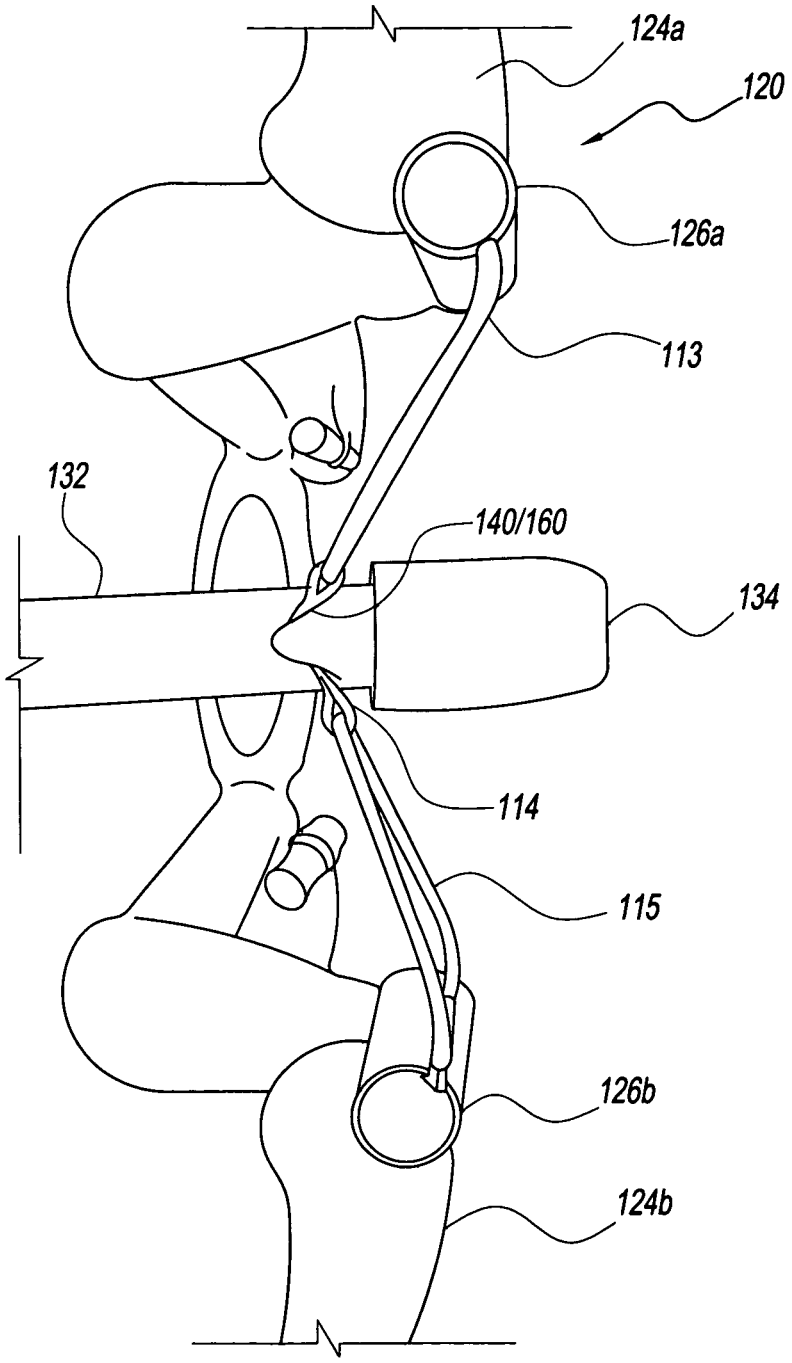
FIG. 5 is a close-up side view of the fore tension band of FIG. 4 within a tension band engagement slot in the arrow of the toy of FIG. 3.

In contrast with the prior art bow (20) shown in FIG. 1 which has two parallel fore tension strings (12*a*) and (12*b*), the arced bow (120) of the preferred embodiment of the present invention has an elastomeric fore tension band (112) which is comprised of three interlinking elastomeric loops (113), (114) and (115). As shown in FIGS. 3, 4 and 5, the top loop (113) is secured at string mount (126*a*) to the bottom of the upper body section (124*a*), and the bottom loop (115) is secured at string mount (126*b*) to the top of the lower body section (124*b*). The normal vectors of the planes of the top and bottom loops (113) and (115) are roughly parallel with the normal vector of the plane of the bow (120), the top loop (113) is roughly triangular with a downwards pointing vertex and the bottom loop (115) is roughly triangular with an upwards pointing vertex. Spanning the top loop (113) and the bottom loop (115) is a middle loop (114) which is interlinked with both the top loop (113) and the bottom loop (115) (as, for instance, links in a chain) and therefore the normal vector to the plane of the middle loop (114) is roughly perpendicular to the normal vector of the plane of the bow (120). Around a mid-section of the middle loop (114), i.e., the region of the middle loop centered between the top and bottom loops (113) and (115), is an elastomeric sleeve (116) which presses the two portions of the middle loop (114) within it together. The elastomeric sleeve (117) and the loops (113), (114) and (115) of the fore tension band (112) may be made of any suitable elastomeric material, such as latex, thermoplastic resin, or the like. It should be noted that the front profile (i.e., the right side as depicted in FIG. 4) of the fore tension band (112), from top to bottom, slants rearwards, is vertical, and then slants forwards. As discussed below, this provides physical guidance for the placement/orientation of the arrow (132) when it is loaded and drawn. Furthermore, according to the present invention, the top and bottom loops (113) and (115) differ in color from the sleeved middle loop (114) and (116) to provide visual guidance so the arrow (132) may be properly placed/oriented.

The bow and arrow toy (110) of the preferred embodiment of the present invention shoots an arrow (130) which has a roughly cylindrical shaft (132), a soft foam tip (134) at the front end of the shaft (132), and three fins (136) projecting laterally outwards at the rear end of the shaft (132). The longitudinal axes of the fins (136) are offset, each at the same angle, relative to the longitudinal axis of the shaft (132). The cantilevered fins (136) generate rotation of the arrow (130) about its longitudinal axis, and therefore gyroscopic stabilization, as it flies. As shown in the cut-away view of FIG. 6B, the shaft (132) of the arrow (130) is constructed of an outer cushioning sheath (151) and a rigid central tube (150). In the preferred embodiment of the present invention the cushioning sheath (151) is made of expanded polyethylene foam and the central tube (150) is a rigid or semi-rigid plastic. To further increase the softness of the tip (134), the tip (134) may include a hollow region (135). Preferably, the central tube (150) has a Shore durometer between 25 and 35 and has a disc-shaped cap (152) at its front end to reduce the likelihood of injury if the foam tip (134) becomes inadvertently separated from the shaft (132). To facilitate weight reduction, the central tube (150) may include holes or apertures.

Figure 6A:
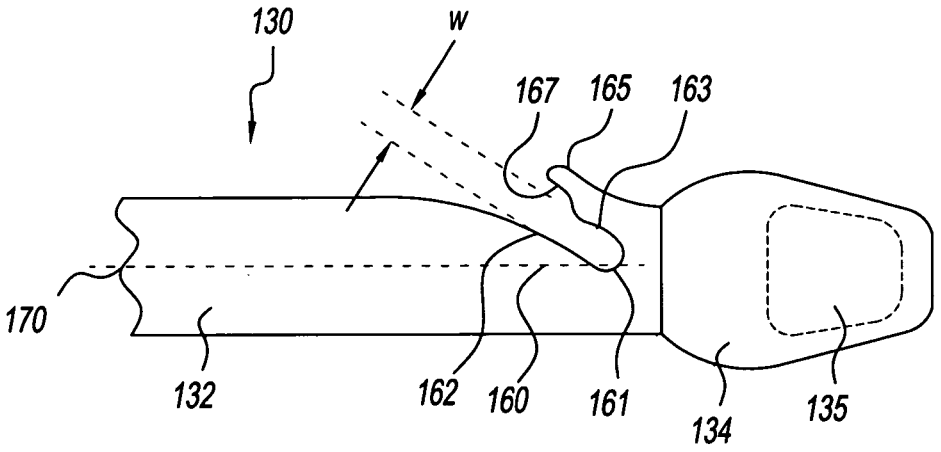
FIG. 6A is a close-up side view of tension band engagement slot of a preferred embodiment of the arrow of the present invention.
Figure 6B:
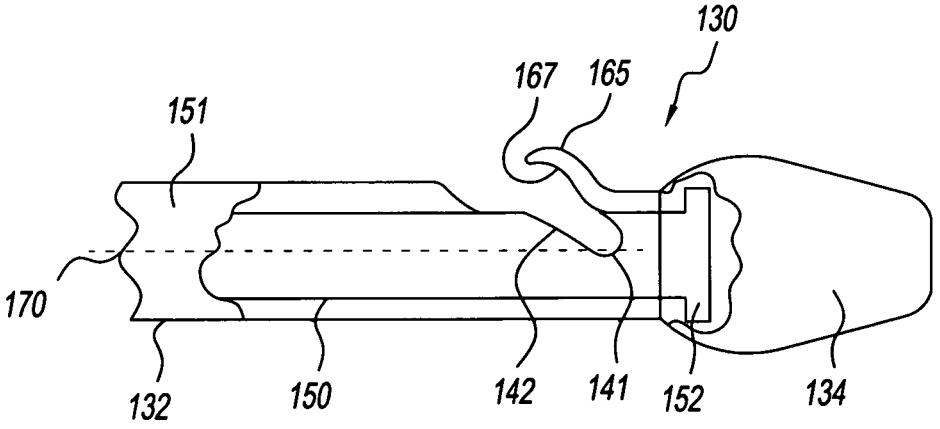
FIG. 6B is a close-up, cut-away side view of the tension band engagement slot of FIG. 6A with a central support cylinder exposed.

As shown in the close-up side views of FIGS. 6A and 6B, near the front of the shaft (132) are forward-slanting engagement slots (160) and (140) in the cushioning sheath (151) and central tube (150), respectively. In side profile the forward-slanting engagement slots (160) and (140), where they overlap, are substantially coincident (and will be referred to collectively as "slot (140)/(160)") and have a transverse width w larger than that of the sleeved middle loop (114) and (116) of the fore tension band (112) so that the sleeved middle loop (114) and (116) may be lodged in the slot (140)/(160). The engagement slot (160)/(140) is located at a distance from the rear end of the shaft (132) that is less than the distance of the center of the unbiased (i.e., undrawn) rear tension string (116) to the center of the unbiased (i.e., undrawn) fore tension band (112). The inside surface (162)/(142) of the engagement slot (160)/(140) arcs smoothly from the being parallel to the longitudinal axis (170) to an angle of roughly 30° to the longitudinal axis (170). At the fore end of the engagement slot (160)/(140) is a catch lip (165) which protrudes outwards from the substantially cylindrical surface of the shaft (132). The rounded terminus (164) of the outer sheath (151) and the rounded terminus of the central tube (150) are located roughly at the mid-plane (170) of the shaft (132) so that the force applied by the sleeved middle loop (114) and (116) to the terminus (161)/(141) is on-axis and does not generate a torque. The central tube (150) provides rigidity to the shaft (132), and provides durability to the slot (140)/(160) which is subject to wear during loading and drawing of the arrow (130), particularly at the terminus (141)/(161) where substantial pressures may be applied.

It should be noted that in contrast with the prior art bow and arrow toy (10) where loading the arrow (30) requires the threading of the foam tip (34) and shaft (32) through the pair of parallel fore tension strings (12*a*) and (12*b*), in the bow and arrow system (110) of the present invention the arrow (130) can be quickly and easily loaded and drawn. In particular, the arrow (130) of the present invention is loaded by abutting the rear of the arrow shaft (130) against the rear tension string (116), pressing the shaft (132) (preferably with horizontal swinging of the arrow (130)) against the fore tension band (112), and pulling back, i.e., drawing, the arrow (130) and rear tension string (116) while maintaining the pressure of the shaft (132) against the fore tension band (112). It should be noted that the design of the fore tension band (112) provides the important advantages of (i) having a relatively simple construction, (ii) providing an easily visible center point to the fore tension band (112), and (iii) providing physical guidance for proper orientation of the arrow (132). When the sleeved middle loop (114) and (116) reaches the mouth of the engagement slot (160)/(140) it will enter the engagement slot (160)/(140) and abut the terminus (161) of the engagement slot (160)/(140). In cases where the pressure of the shaft (130) against the fore tension band (112) is not of sufficient magnitude to cause the fore tension band (112) to enter the engagement slot (160)/(140) by sliding along the inside surface (162)/(142) of the engagement slot (160)/(140), the rear surface (167) of the catch lip (165) will guide the fore tension band (112) into the engagement slot (160)/(140). As the arrow (130) and rear tension string (116) are pulled back further, the engagement of the engagement slot (160)/(140) with the sleeved middle loop (114) and (116) will extend the fore tension band (112) and increase the tension in the fore tension band (112). Furthermore, because the top and bottom portions of the fore tension band (112), i.e., the top and bottom loops (113) and (115), slant rearwards towards the center of the band (112), if the arrow (132) is initially oriented away from horizontal, the arrow (132) is guided to a horizontal orientation by the front profile of the fore tension band (112) as it (132) is drawn.

Although the above description of loading and drawing the arrow (132) in the bow and arrow toy (110) of the present invention involves a number of steps, an advantage of the bow and arrow toy of the present invention is that the loading and drawing process described above can actually be implemented in a single, natural motion. Just as the revolver was a huge advance in weaponry because it made reloading essentially instantaneous, the rapid loading and drawing of the arrow provided by the bow and arrow toy of the present invention is a major advance over the prior art in play bow-and-arrow combat.

Upon release of the rear end of the shaft (132) of the arrow (130), the forward directed forces applied by the rear tension string (116) and the fore tension band (112) propel the arrow (130) forward and the arrow (130) is launched from the bow (120) into its trajectory.

The foregoing descriptions of specific embodiments of the present invention have been presented for purposes of illustration and description. They are not intended to be exhaustive or to limit the invention to the precise forms disclosed, and it should be understood that many modifications and variations are possible in light of the above teaching. The embodiments were chosen and described in order to best explain the principles of the invention and its practical application, to thereby enable those skilled in the art to best utilize the invention and various embodiments with various modifications as are suited to the particular use contemplated. Many other variations are possible. For example: the tension strings may be made of any suitable elastomeric material; the bow body may be made of any suitable material such as wood or a plastic; the shaft of the arrow may have a different construction; the fore tension band may be made of an integrally formed single elastomeric element; the fore tension band may be constructed from more or less than three interlinked loops, such as two interlinked loops; the bow and arrow may more generically be a projectile launcher, such as a toy plane launcher, a rocket launcher, etc.; the bow may be a compound bow or a recurve bow; the central loop of the fore tension band may take another form; the central loop may take another form and may be a rigid or inelastic member; etc. Furthermore, the description of the physical principles underlying the operation and performance of the present invention are also presented for purposes of illustration and description, and are not intended to be exhaustive or limiting. It should be understood that these descriptions may include approximations, simplifications and assumptions to present the basic concepts, and effects which influence the operation and performance may be neglected for ease of presentation. Accordingly, it is intended that the scope of the invention should be determined not by the embodiments illustrated or the physical analyses motivating the illustrated embodiments, but rather by the appended Claims and their legal equivalents.

What is claimed is:

1. A bow and arrow toy comprising:

a bow having an elastomeric fore tension band, an elastomeric rear tension band, and an arced body where the arc of said body is concave to the rear, said rear tension band being secured to said body at an upper rear point of said body and a lower rear point of said body, and said fore tension band being secured to said body at a forward upper point and a forward lower point, when unbiased said fore and rear tension bands being separated by a band separation distance; and an arrow having an elongate shaft with multiple fins protruding from said shaft at the rear of said shaft, a soft tip at the fore of said shaft, and a forward slanting engagement slot having a width greater than a width of said fore tension band so said fore tension band may be lodged in said engagement slot, said engagement slot being a distance greater than said band separation distance from the rear of said arrow, said arrow being launchable from said bow by abutting a rear end of said shaft against said rear tension band and pressing a side of said shaft with said engagement slot against said fore tension band, drawing said arrow and said rear tension band back, allowing said fore tension band to enter said engagement slot and abut a terminus of said engagement slot, continuing to draw said arrow back thereby increasing tension of said fore and rear tension bands and increasing forward forces applied by the fore and rear tension bands to said arrow, and releasing said arrow to allow said forward forces applied by said fore and rear tension bands to launch said arrow from said bow.

2. The bow and arrow toy of claim 1 wherein said terminus of said engagement slot is on a longitudinal mid-plane of said elongate shaft.

3. The bow and arrow toy of claim 1 wherein said fore tension band has multiple interlinked loops of an elastomeric material.

4. The bow and arrow toy of claim 3 wherein said multiple interlinked loops include a top loop, a bottom loop and a middle loop.

5. The bow and arrow toy of claim 4 wherein first and second normal vectors of said top and bottom loops are substantially parallel to a third normal vector of a plane of said bow, and a fourth normal vector of said middle loop is substantially perpendicular to said third normal vector.

6. The bow and arrow toy of claim 5 wherein a front profile of said fore tension band is, from top to bottom, slanting rearwards, vertical, and slanting forwards.

7. The bow and arrow toy of claim 6 further including a sleeve around a mid-section of said middle loop, said mid-section of said middle loop being roughly mid-way between said top and bottom loops, said sleeve pressing two portions of said middle loop together thereby producing a reduced effective width.

8. The bow and arrow toy of claim 7 wherein said sleeve is cylindrical and is clastomeric.

9. The bow and arrow toy of claim 1 further including a catch lip protruding from said shaft of said arrow at a fore outside edge of said engagement slot, said catch lip functioning to guide said fore tension band into said engagement slot if said pressing of said side of said shaft is not sufficient to cause said tension band to slide along an inside surface of said engagement slot.

* * * * *